US008302512B2

(12) United States Patent
Shih

(10) Patent No.: US 8,302,512 B2
(45) Date of Patent: Nov. 6, 2012

(54) LOCKING PLIERS WITH RETRACTABLE PIVOTAL MOVABLE JAW

(76) Inventor: Shin-An Shih, Taichung (TW)

( * ) Notice: Subject to any disclaimer, the term of this patent is extended or adjusted under 35 U.S.C. 154(b) by 346 days.

(21) Appl. No.: 12/850,601

(22) Filed: Aug. 4, 2010

(65) Prior Publication Data

US 2012/0031243 A1 Feb. 9, 2012

(51) Int. Cl.
*B25B 7/12* (2006.01)

(52) U.S. Cl. ..... 81/355; 81/365; 81/378; 269/6

(58) Field of Classification Search ..... 81/318, 81/342, 355, 365, 367, 368, 373, 375, 378, 81/380; 269/6, 228
See application file for complete search history.

(56) References Cited

U.S. PATENT DOCUMENTS

| | | | | | |
|---|---|---|---|---|---|
| 347,580 | A * | 8/1886 | Dean | ..... | 81/328 |
| 1,056,693 | A * | 3/1913 | Krahulec | ..... | 81/328 |
| 2,407,546 | A * | 9/1946 | Gearhart | ..... | 81/306 |
| 2,452,625 | A * | 11/1948 | Alpers | ..... | 81/375 |

* cited by examiner

*Primary Examiner* — Alicia Torres

(57) ABSTRACT

A locking pliers includes a slide bar mounted in both second handle unit and locking unit and comprising a wavy edge facing bottom of the second handle unit, the wavy edge including a rear slot member and a forward hook; and a movable jaw at a forward end of the second handle unit and comprising two intermediate opposite stop members each having an inclined edge, a channel between the stop members with a forward end of the slide bar movably received therein, and a rear stop bar interconnected two sidewalls of a rear portion of the movable jaw, the inclined edges being stopped by bending members on sidewalls of the second handle unit for retaining the stop members in an inoperative position.

1 Claim, 8 Drawing Sheets

5-5

3

4-4

8-8

A

LOCKING PLIERS WITH RETRACTABLE PIVOTAL MOVABLE JAW

BACKGROUND OF THE INVENTION

1. Field of Invention

The invention relates to locking pliers and more particularly to a pair of locking pliers with improved characteristics.

2. Description of Related Art

A pair of typical locking pliers is shown in FIG. 11 and comprises a first handle unit 1, a stationary jaw 3 pivotably secured to the first handle unit 1, a second handle unit 2 pivotably secured to the stationary jaw 3, a slide bar 4 extending outwardly laterally from a forward end of the second handle unit 2, a movable jaw 5 slidably mounted on the slide bar 4, and a self-adjusting locking unit (not numbered) interconnected between the first and second handle units 1, 2.

In use, the jaws 3, 5 are opened a sufficient distance by sliding the movable jaw 5 along the slide bar 4. Next, an object is placed between the jaws 3, 5. Next, squeeze the first and second handle units 1, 2 together to lock the jaws 3, 5 onto the gripped object.

However, the conventional locking pliers suffer from a number of disadvantages. For example, the slide bar 4 can cause inconvenience in storage and transportation. Moreover, it is visually unattractive. Further, it is not suitable to be used in areas to which access is difficult or in which there is limited clearance. Thus, the need for improvement still exists.

SUMMARY OF THE INVENTION

It is therefore one object of the invention to provide a locking pliers comprising a hollow first handle unit; a stationary jaw having one corner of a rear end pivotably secured to the first handle unit and comprising a locking recess at the other corner of the rear end; a hollow second handle unit pivotably secured to the other corner of the rear end of the stationary jaw and comprising a lengthwise hollow, a trough at a forward end of the hollow, two inward bending members on both sidewalls of the hollow respectively, the bending members being disposed proximate to an inner mouth of the trough, and a U-shaped opening disposed proximate to an outer mouth of the trough; a pivotal locking unit interconnected between the first and second handle units; a slide bar mounted in both the second handle unit and the locking unit and comprising a wavy edge facing bottom of the hollow, the wavy edge including a rear slot member and a forward hook; an adjustment screw extending rearward of the second handle unit; a U-shaped member engaged with and between the adjustment screw and the locking unit, the U-shaped member being adapted to receive a rear portion of the slide bar; and a movable jaw disposed at a forward end of the second handle unit and comprising two intermediate opposite stop members each having an inclined edge, a channel formed between the stop members with a forward end of the slide bar movably received therein, and a rear stop bar interconnected two sidewalls of a rear portion of the movable jaw, the inclined edges being stopped by the bending members for retaining the stop members in an inoperative position.

The above and other objects, features and advantages of the invention will become apparent from the following detailed description taken with the accompanying drawings.

DETAILED DESCRIPTION OF THE INVENTION

Referring to FIGS. 1 to 9, a pair of locking pliers in accordance a first preferred embodiment of with the invention is shown.

Figure 1:
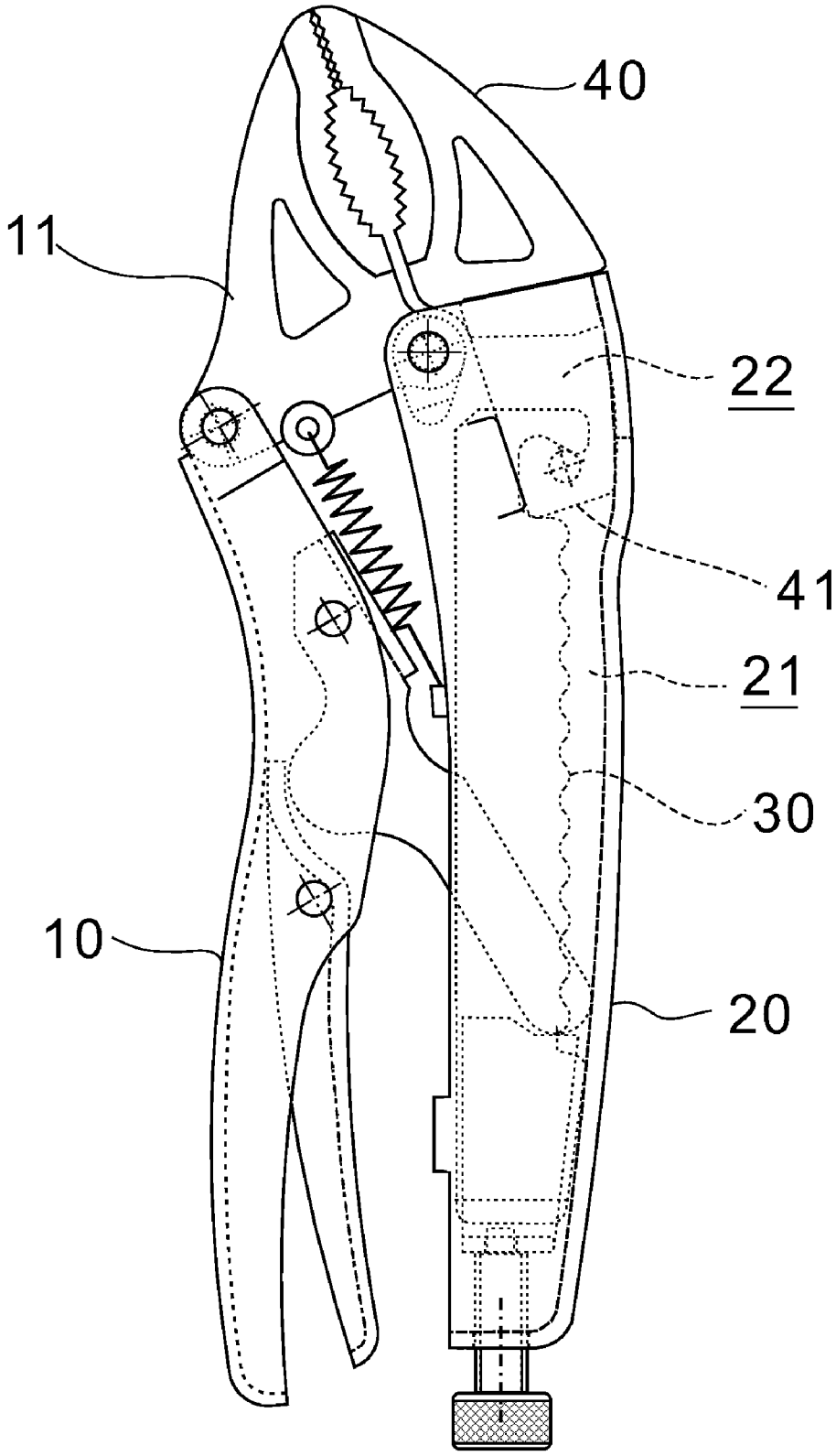
FIG. 1 is a side elevation of a pair of locking pliers according to a first preferred embodiment of the invention.
Figure 2:
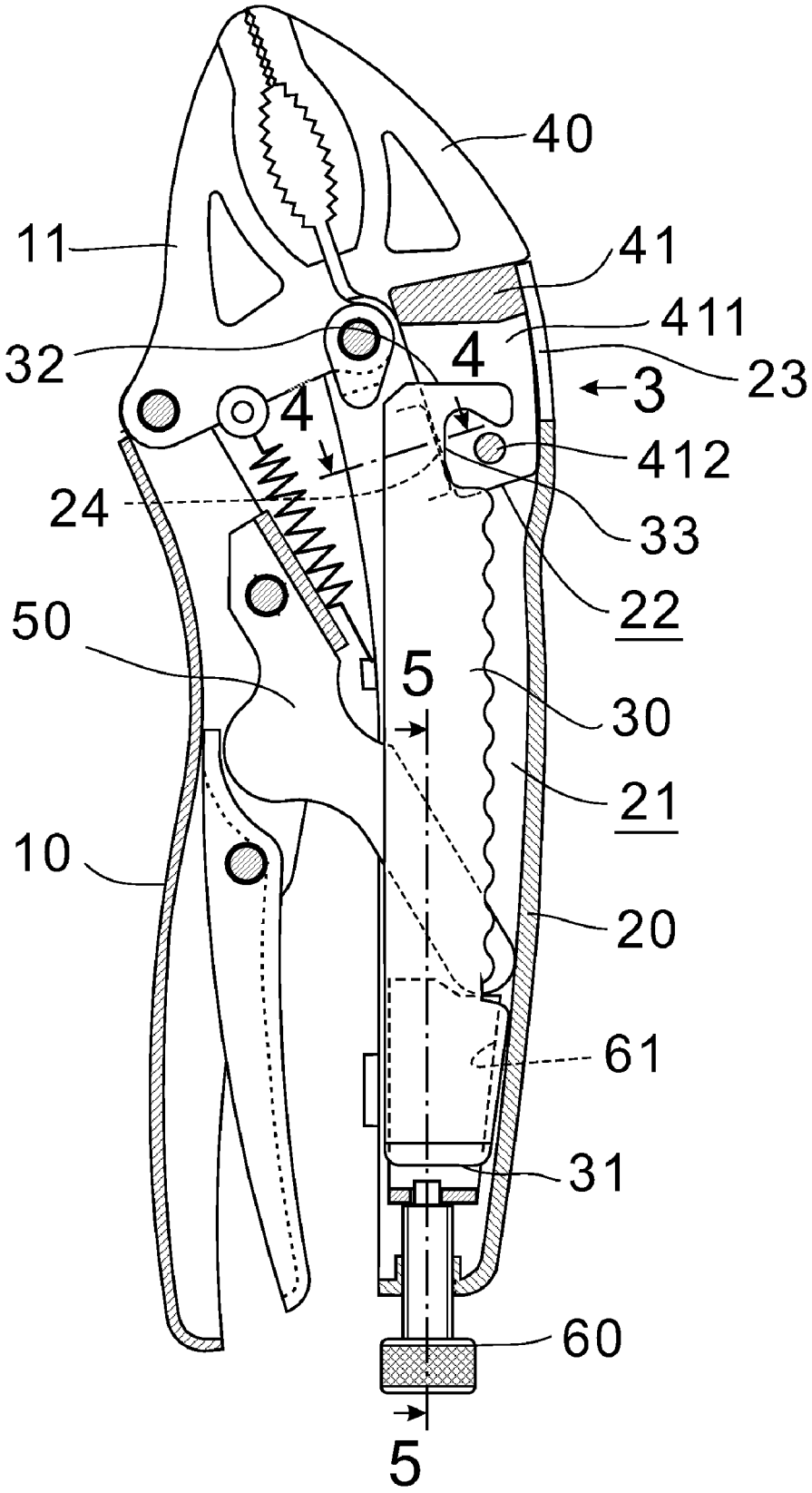
FIG. 2 is a sectional view of portions of the locking pliers.
Figure 5:
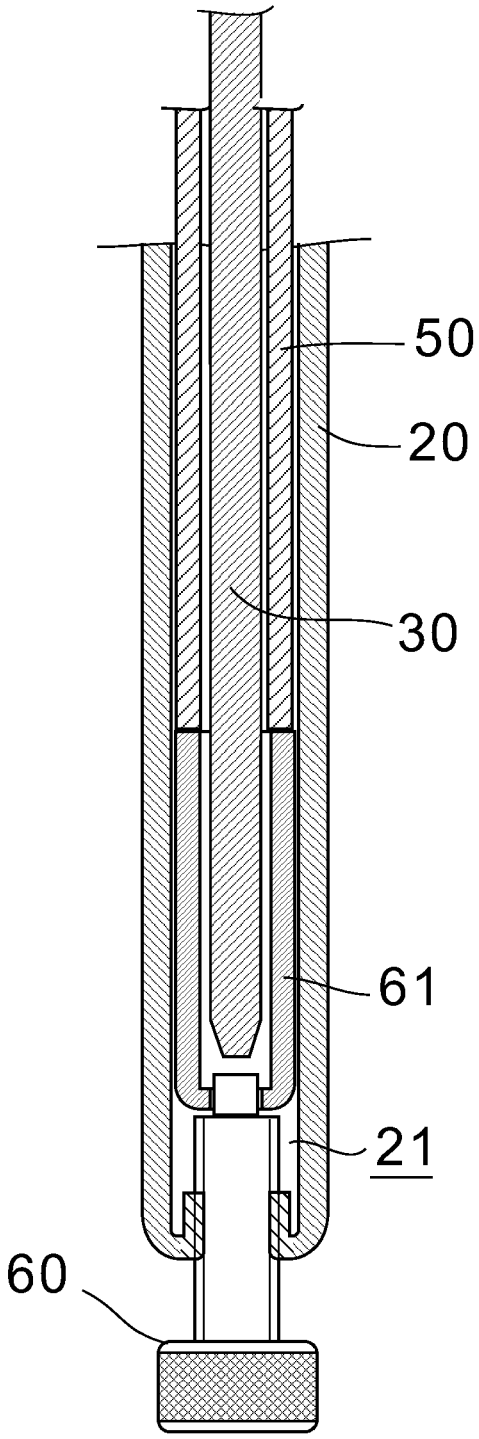
FIG. 5 is a sectional view taken along lines 5-5 of FIG. 2.
Figure 3:
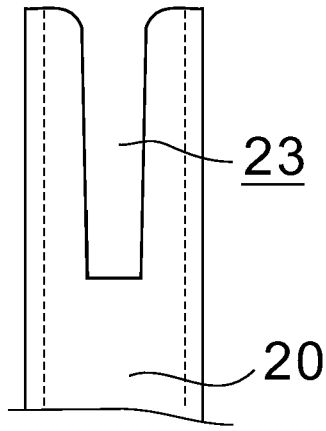
FIG. 3 is a front view taken from arrow 3 of FIG. 2.
Figure 4:
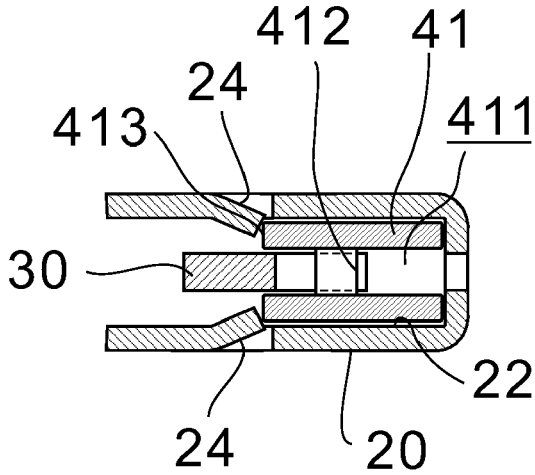
FIG. 4 is a sectional view taken along lines 4-4 of FIG. 2.

The locking pliers comprises a hollow first handle unit 10, a substantially triangular stationary jaw 11 having one rear end pivotably secured to a forward end of the first handle unit 10, a second handle unit 20 pivotably secured to the other rear end of the stationary jaw 11, a movable jaw 40 at a forward end of the second handle unit 20, a spring loaded, pivotal locking unit 50 interconnected between the first and second handle units 10, 20, a slide bar 30 mounted in a hollow 21 of the second handle unit 20 (also partially in the hollow of the locking unit 50 as shown in FIG. 5), and an adjustment screw 60 extending rearward of the second handle unit 20, the adjustment screw 60 being adapted to adjust the spacing of the jaws 11, 40 by threading. The adjustment screw 60 has a U-shaped member 61 at its forward end. The U-shaped member 61 has a forward end urged against the locking unit 50. A rear portion of the slide bar 30 is received in the U-shaped member 61. A user may turn the adjustment screw 60 to push the U-shaped member 61 which in turn pushes the locking unit 50 for pivoting the locking unit 50.

The second handle unit 20 further comprises a forward trough 22 at a forward portion of the hollow 21, two inward bending members 24 formed by punching openings on both sidewalls respectively, the bending members 24 disposed proximate inner mouth of the trough 22, and a forward U-shaped opening 23 disposed proximate outer mouth of the trough 22.

The slide bar 30 is elongated and comprises a wavy edge 35 facing the inner surface of the second handle unit 20. The movable jaw 40 comprises two intermediate opposite stop members 41 each having an inclined edge 413, a channel 411 formed between the stop members 41, and a rear stop bar 412 interconnecting two rear side walls of the movable jaw 40. The inclined edges 413 are stopped by the bending members 24 for retaining the stop members 41 in an inoperative position.

Channel 411 has a width slightly greater than thickness of the slide bar 30. The stop bar 412 is disposed in the forward most hook 33 of the wavy edge 35 of the slide bar 30 proximate to the forward end 32 of the slide bar 30 in an inoperative position (see FIG. 2).

Figure 6:
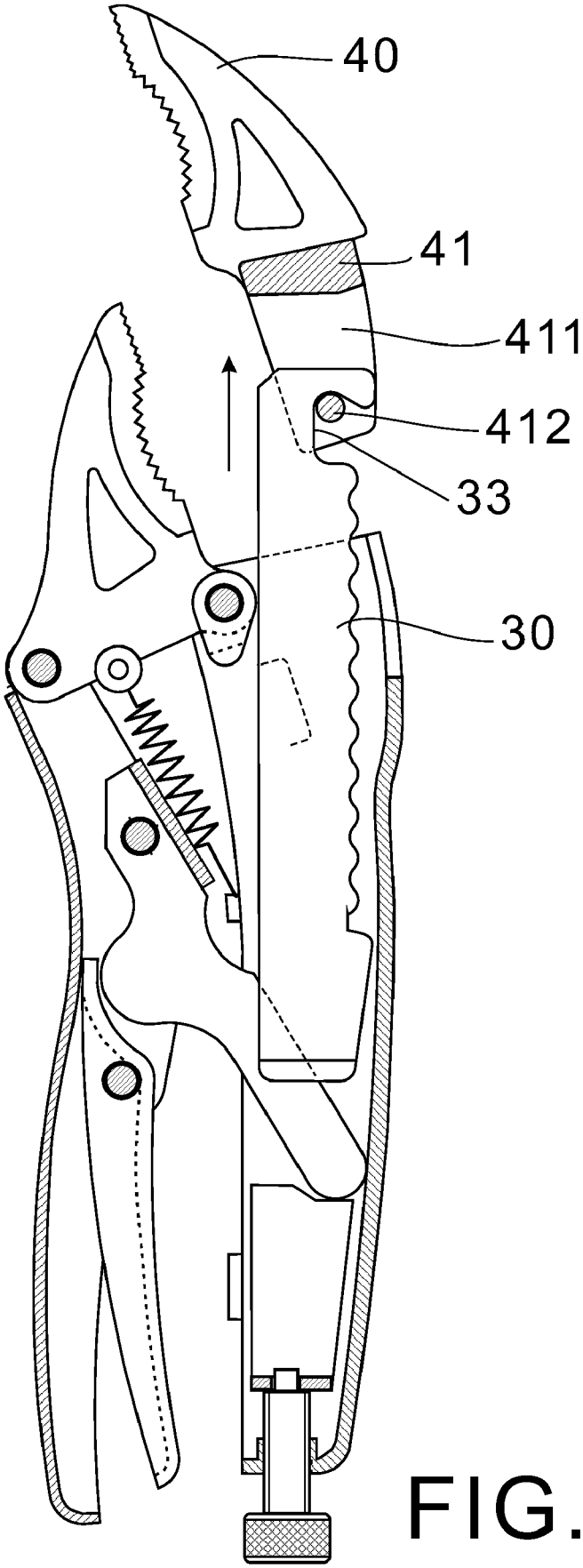
FIG. 6 is a view similar to FIG. 2 showing the slide bar being pulled to open the jaws.
Figures 7, 8:
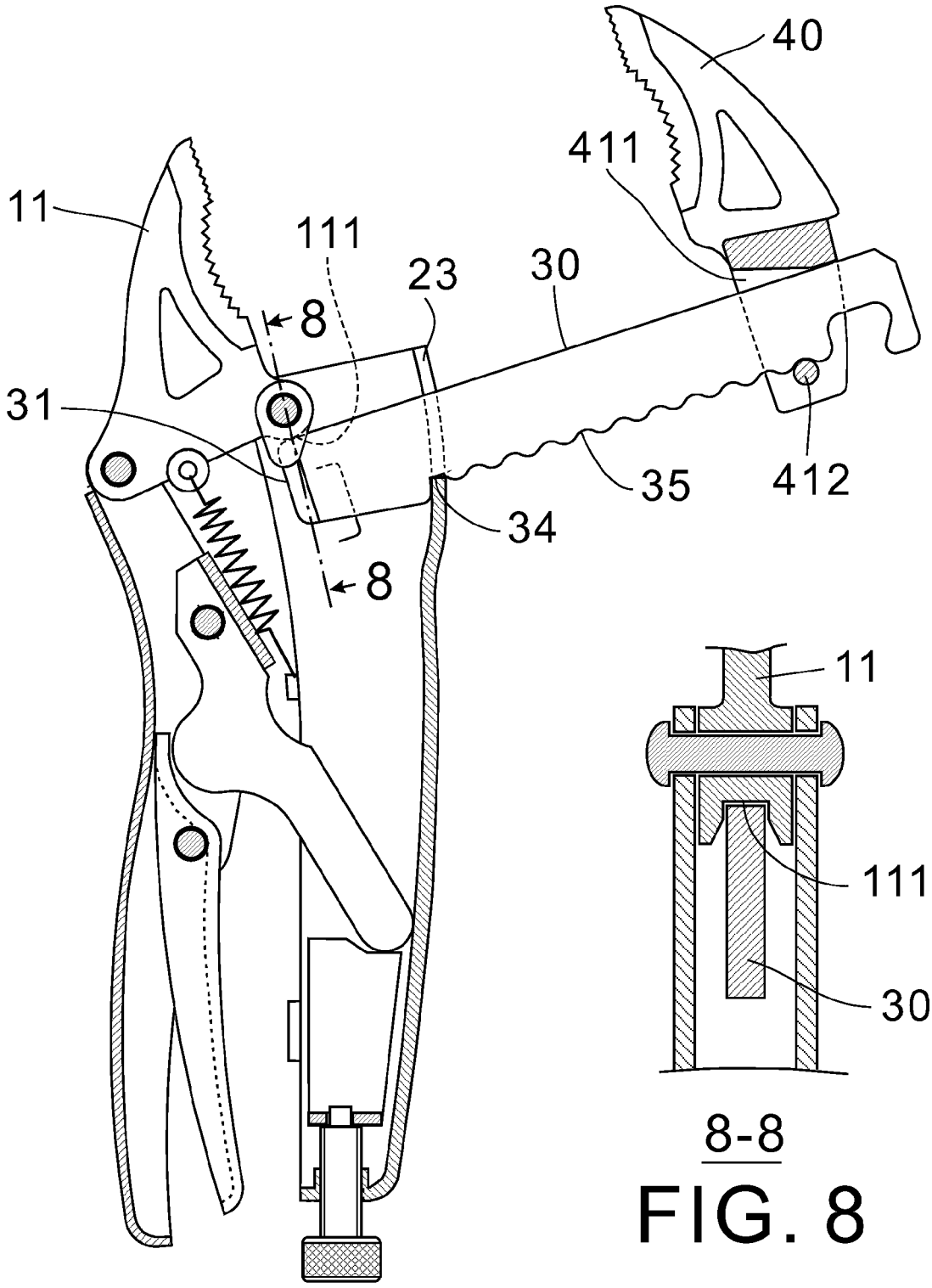
FIG. 7 is a view similar to FIG. 6 showing the slide bar being further pivoted clockwise to increase a distance between the jaws.
FIG. 8 is a sectional view taken along lines 8-8 of FIG. 7.

For operating the slide bar 30, a user may pull the movable jaw 40 to engage the stop bar 412 with the hook 33 of the wavy edge 35 of the slide bar 30 so that both the movable jaw 40 and the slide bar 30 can be pulled as a whole as indicated by arrow in FIG. 6. After the pulling being stopped, the user may clockwise pivot the slide bar 30 to cause the rear most slot member 34 to rest upon the bottom of a forward opening 23 of the second handle unit 20. The stop bar 412 is engaged with the valley next to the hook 33 of the slide bar 30 (see FIG. 7). A locking recess 111 is formed at the pivotal joining portion of the stationary jaw 11 and the second handle unit 20 (see FIG. 8). The rear end of the slide bar 30 is locked in the locking recess 111 in this jaw opening operation. The slide bar 30 is thus retained. Next, the user may adjust the engagement point of the wavy edge 35 and the stop bar 412 by moving the movable jaw relative to the slide bar by moving the stop bar along the wavy edge for obtaining a desired distance of the jaws 11, 40. Thereafter, the user may place an object (not shown) between the jaws 11, 40. Next, squeeze the first and second handle units 10, 20 together to lock the jaws 11, 40 onto the gripped object.

Figure 9:
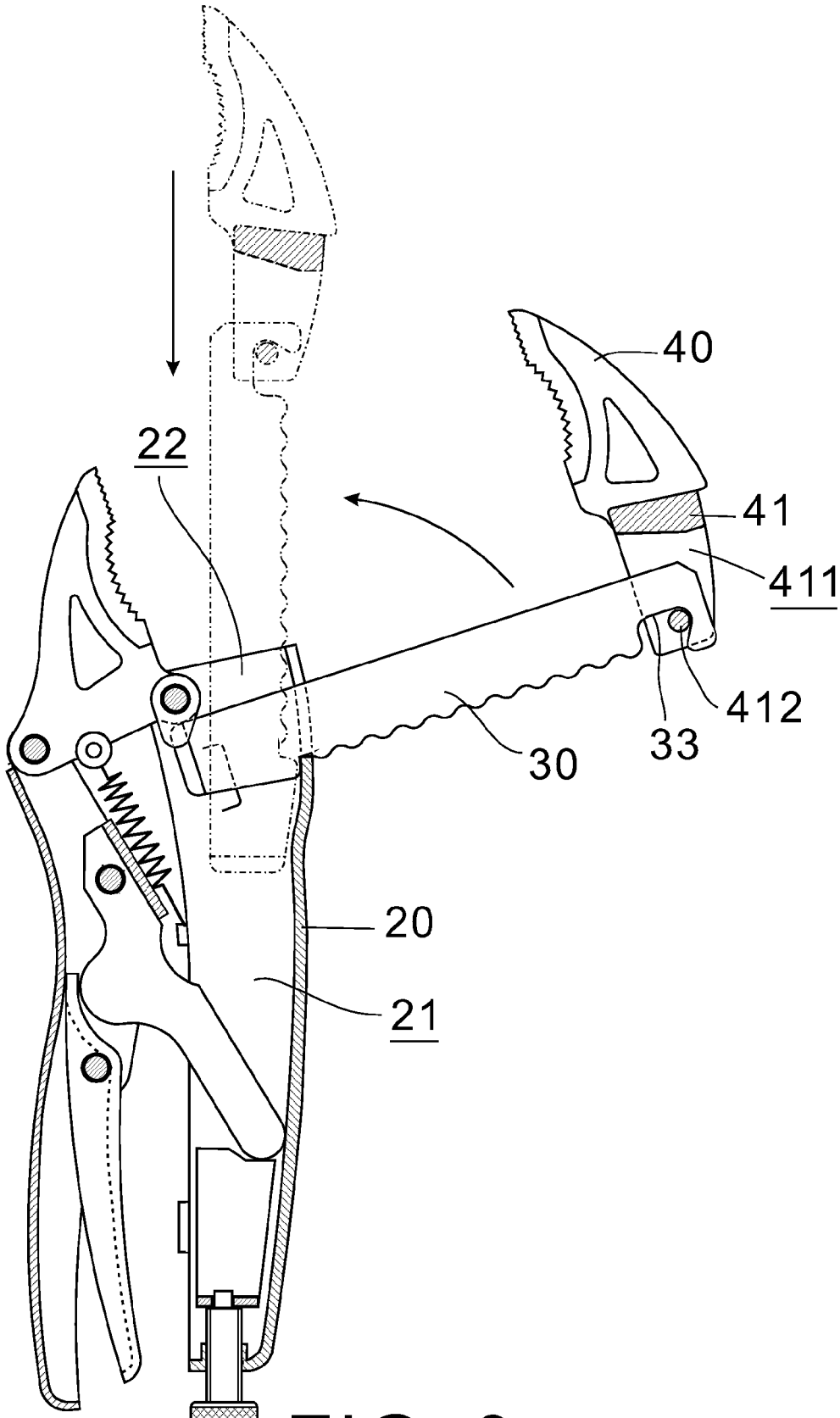
FIG. 9 is a view similar to FIG. 7 showing the slide bar being pivoted and pushed to its original position of FIG. 2.

To the contrary, steps taken in reverse can retract the slide bar 30 into its original position as shown in FIG. 9.

Figures 10, 10A:
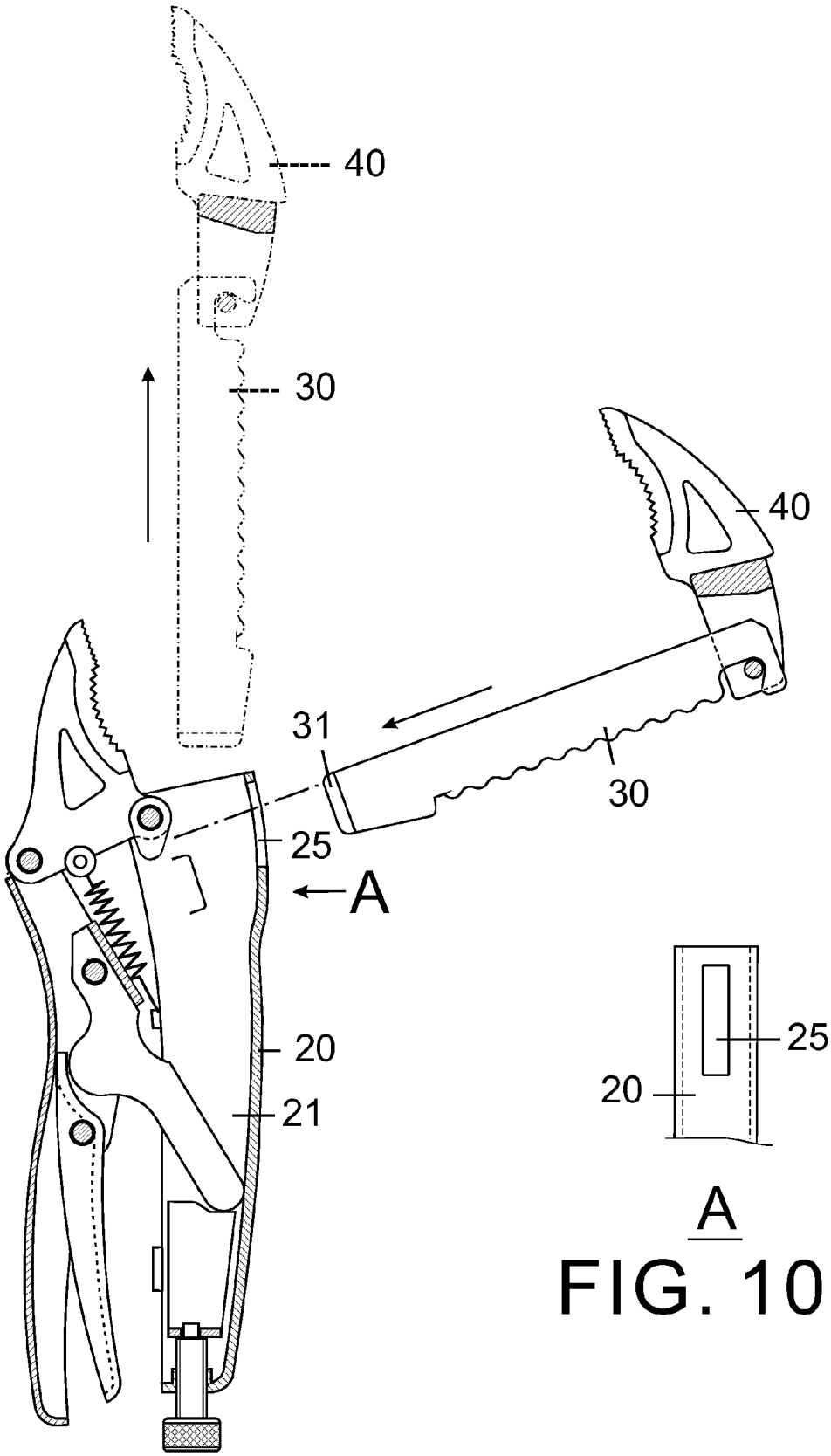
FIG. 10 is a side elevation in part section of a locking pliers according to a second preferred embodiment of the invention for showing a pulling of the slide bar and the movable jaw and a subsequent insertion of the same into the second handle unit.
FIG. 10A is a front view taken from arrow A of FIG. 10.
Figure 11:
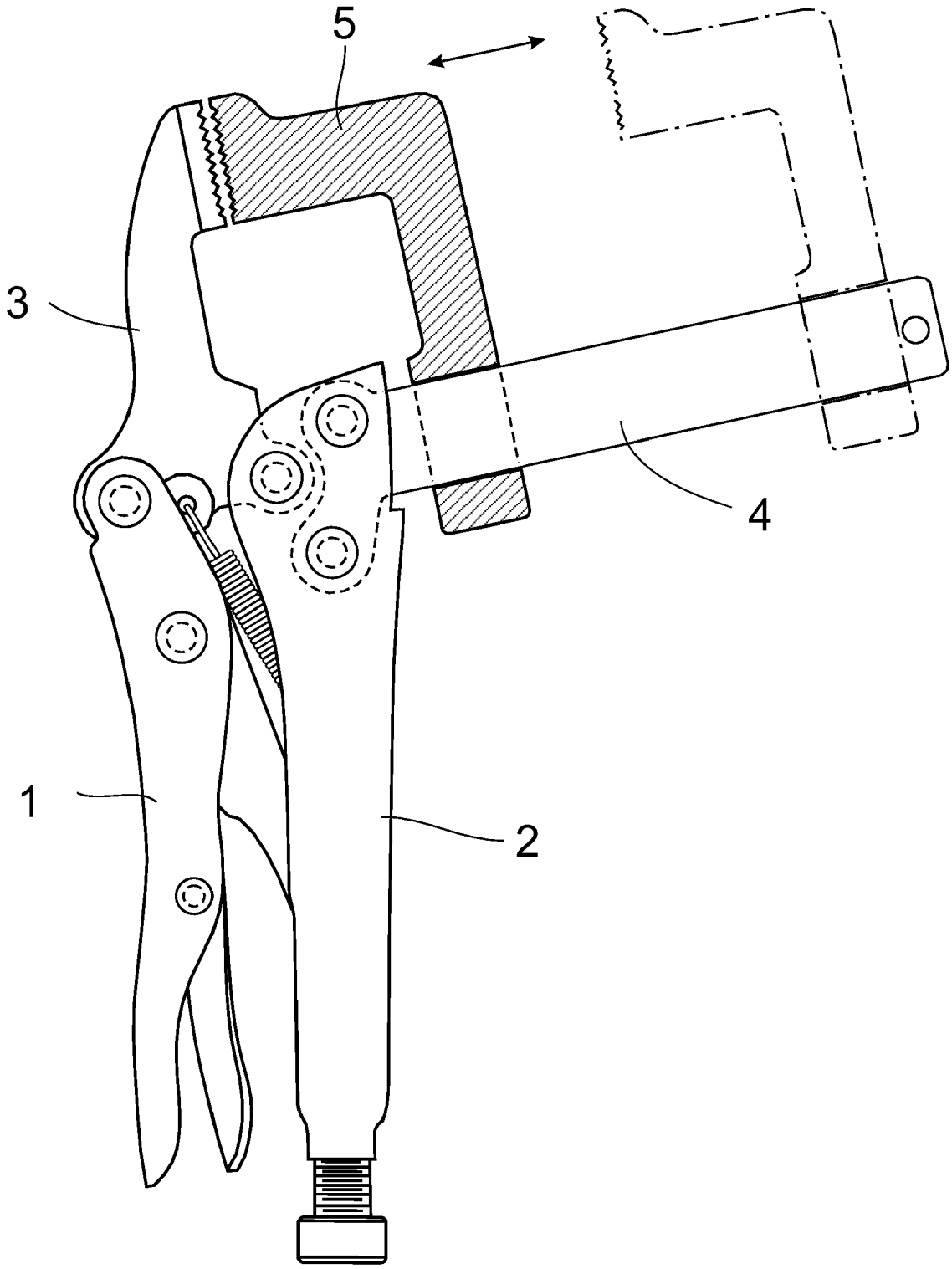
FIG. 11 PRIOR ART
FIG. 11 is a side elevation in part section of a pair of typical locking pliers.

Referring to FIGS. 10 and 10A, a pair of locking pliers in accordance a second preferred embodiment of with the invention is shown. The characteristics of the second preferred embodiment are detailed below. The U-shaped opening 23 is replaced with a rectangular slot 25. The slide bar 30 and the movable jaw 40 can be removed from the second handle unit 20 by pulling upward as indicated by the upward directed arrow. Thereafter, insert the rear end 31 of the slide bar 30 through the slot 25 into the hollow 21 as indicated by transverse arrow pointing toward left. The cross-section of the slide bar 30 is slightly smaller than that of the slot 25. Hence, the slide bar 30 is substantially stable in this position without being loosen.

After use, steps taken in reverse can retract the slide bar 30 into its original position.

While the invention has been described in terms of preferred embodiments, those skilled in the art will recognize that the invention can be practiced with modifications within the spirit and scope of the appended claims.

What is claimed is:

1. A locking pliers comprising:

a hollow first handle unit (10);

a stationary jaw (11) having one corner of a rear end pivotably secured to the first handle unit (10) and comprising a locking recess (111) at the other corner of the rear end;

a hollow second handle unit (20) pivotably secured to the other corner of the rear end of the stationary jaw (11) and comprising a lengthwise hollow (21), a trough (22) at a forward end of the hollow (21), two inward bending members (24) on both sidewalls of the hollow (21) respectively, the bending members (24) being disposed proximate to an inner mouth of the trough (22), and a U-shaped opening (23) disposed proximate to an outer mouth of the trough (22);

a pivotal locking unit (50) interconnected between the first and second handle units (10, 20);

a slide bar (30) mounted in both the second handle unit (20) and the locking unit (50) and comprising a wavy edge (35) facing bottom of the hollow (21), the wavy edge (35) including a rear slot member (34) and a forward hook (35);

an adjustment screw (60) extending rearward of the second handle unit (20);

a U-shaped member (61) engaged with and between the adjustment screw (60) and the locking unit (50), the U-shaped member (61) being adapted to receive a rear portion of the slide bar (30); and a movable jaw (40) disposed at a forward end of the second handle unit (20) and comprising two intermediate opposite stop members (41) each having an inclined edge (413), a channel (411) formed between the stop members (41) with a forward end of the slide bar (30) movably received therein, and a rear stop bar (412) interconnected two sidewalls of a rear portion of the movable jaw (40), the inclined edges (413) being stopped by the bending members (24) for retaining the stop members (41) in an inoperative position, whereby pulling the movable jaw (40) to engage the stop bar (412) with the hook (33), further pulling both the movable jaw (40) and the slide bar (30), clockwise pivoting the slide bar (30) until the slot member (34) is rested upon bottom of the opening (23) and a rear end of the slide bar (30) is retained in the locking recess (111), and moving the movable jaw (40) relative to the slide bar (30) by moving the stop bar (412) along the wavy edge (35) will adjust a distance between the stationary jaw (11) and the movable jaw (40).

* * * * *